United States Patent [19]

Rhodes

[11] 4,438,702

[45] Mar. 27, 1984

[54] ENDLESS CONVEYOR SYSTEM

[76] Inventor: Arthur B. Rhodes, 7227 Helen Ave., Louisville, Ky. 40258

[21] Appl. No.: 393,754

[22] Filed: Jun. 30, 1982

[51] Int. Cl.[3] ..... B61B 10/00

[52] U.S. Cl. ..... 104/172 B; 104/172 BT; 198/606

[58] Field of Search ..... 104/172 B, 172 BT, 185, 104/187, 96, 172 R; 198/606, 377, 339, 345

[56] References Cited

U.S. PATENT DOCUMENTS

| | | | |
|---|---|---|---|
| 2,779,453 | 1/1957 | Lippert et al. | 198/377 |
| 3,048,126 | 8/1962 | Salapatas | 104/96 X |
| 3,103,274 | 9/1963 | Mayrath | 198/606 X |
| 4,086,855 | 5/1978 | Newbegin | 104/172 BT |
| 4,266,482 | 5/1981 | Barber | 104/172 B |

*Primary Examiner*—Randolph Reese
*Assistant Examiner*—Gregory A. Beehner
*Attorney, Agent, or Firm*—Charles G. Lamb

[57] ABSTRACT

An endless conveyor system for moving load bearing units along a path defined by the conveyor system which has a discontinuity or gap along the path such as may be required to accommodate a conveyor system drive or tensioning device. The endless conveyor system includes a transfer station located at the discontinuity or gap to move the load bearing units across the discontinuity without interruption to the flow of load bearing units along the path.

15 Claims, 7 Drawing Figures

ENDLESS CONVEYOR SYSTEM

BACKGROUND OF THE INVENTION (A) Field of The Invention

This invention relates to conveyor systems for moving load bearing units, such as wheeled carts and pallets, along a path defined by the conveyor system. More particularly, the invention is to a conveyor system which has a discontinuity or gap along the path with a transfer station to transport the load bearing units smoothly across the discontinuity without interrupting the flow of load bearing units along the path.

(B) Description of the Prior Art

Conveyor systems for transporting load bearing units, such as wheeled carts, along a path defined by the conveyor system are well known. Examples of some of these types of conveyor systems are shown in U.S. Pat. No. 2,918,020; U.S. Pat. No. 3,032,173; U.S. Pat. No. 3,045,610; U.S. Pat. No. 3,048,126; U.S. Pat. No. 3,194,177; U.S. Pat. No. 3,196,807; U.S. Pat. No. 3,390,641; U.S. Pat. No. 3,467,025; U.S. Pat. No. 3,618,532; U.S. Pat. No. 3,648,618; and U.S. Pat. No. 3,874,302.

Typically, for one reason or another, endless conveyor systems have discontinuities or gaps along the conveyor path along which the load bearing units are to be moved. In some situations, the discontinuity or gap is the result of having to provide a drive motor for powering the endless conveyor system. In other situations, the discontinuity or gap is the result of having to provide tensioning devices required to maintain the path defining flight of the endless conveyor in a taught condition. In even other situations the discontinuity or gap in the conveyor path is created at the intersection of two separate conveyor devices which cooperate to form the conveyor system. Regardless of the cause of the discontinuity or gap in the path defined by the conveyor system, it is important, particularly in a production line installation, that the load bearing units move in a continuous, smooth, uninterrupted flow along the conveyor path for the reason that an interruption in the flow would adversely effect the progress of the work being done.

Various solutions have been proposed by the prior art as exemplified by the above-listed U.S. Patents. However, they are complicated which makes them expensive to make and maintain in operation. Further, these systems do not provide uninterrupted flow of load bearing units along the conveyor path provided for by the present invention.

SUMMARY OF THE INVENTION

The present invention recognizes the drawbacks of the prior art and provides a solution which is straightforward, and therefore, relatively inexpensive to maintain in operation, and moves load carrying units in a smooth, continuous, even, uninterrupted flow along the defined conveyor path.

More particularly, the present invention provides a conveyor system for moving load bearing units along a path defined by the conveyor system comprising endless conveyor means having at least one flight thereof defining the path to be traveled by the load bearing units, the at least one path defining flight having an endless conveyor transfer device disposed across the discontinuity in the at least one path defining flight of the endless conveyor system; fixed position finger means attached to each of the load bearing units, the finger means being adapted to engage the endless conveyor transfer device for movement of the load bearing units with the endless conveyor transfer device across the discontinuity; moveable pin means attached to each of the load bearing units, the pin means being moveable between endless conveyor device engaged in position, in which engaged position the load bearing units are connected to the at least one path defining flight of the endless conveyor means for movement therewith along the defined path, and an endless conveyor means disengaged position; and, means for activating the moveable pin means to the endless conveyor means disengaged position proximate the upstream end of the discontinuity as the finger means engages the endless conveyor transfer device, and for activating the moveable pin means to the endless conveyor means engaged position proximate the downstream end of the discontinuity as the finger means disengages the endless conveyor transfer device.

BRIEF DESCRIPTION OF THE DRAWING

A better understanding of the present invention will be gained upon reading the following description in conjunction with the accompanying drawing in which like parts are identified by like numbers and wherein.

DETAILED DESCRIPTION

Figure 1:
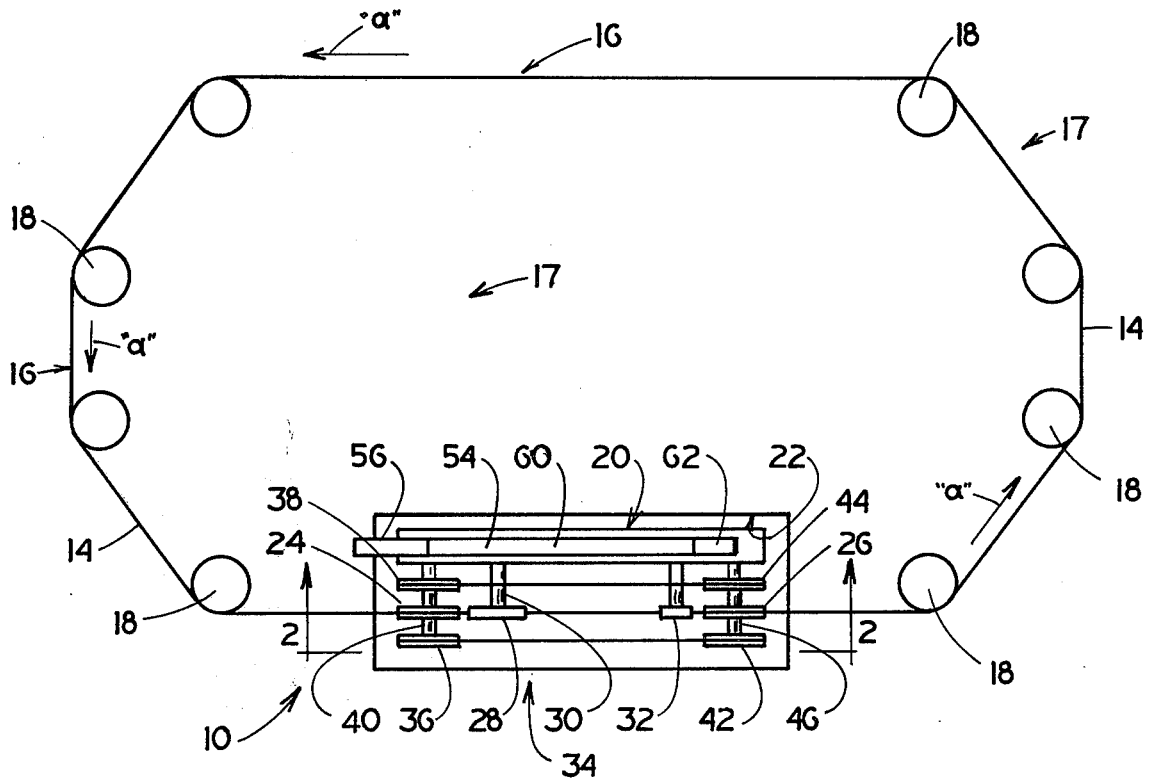
FIG. 1 is a plan view of a conveyor system embodying the present invention.

FIG. 1 is a plan view of a conveyor system, generally denoted as the number 10, for moving load bearing units such as carts 12 along a path defined by the conveyor system. Such conveyor systems are generally known, and have particular application in, for example, manufacturing for moving work pieces through various work stations.

The conveyor system 10 comprises an endless conveyor chain 14 having a generally horizontal run or flight 16 which moves along the floor 17 of a facility defining the path through which the carts 12 will move. In some installations, the top flight 16 of the conveyor chain 14 will move in a trench formed in the facility floor 17 and in other installations the top flight 16 of the conveyor chain 14 will be located at or just above the facility floor 17. As shown in FIG. 1, the horizontal flight 16 of the conveyor chain 14 is located just above the level of the floor 17 and is trained at least partially around guide sprockets 18 at approximate locations along the horizontal flight 16 of the conveyor chain 14 to curve the horizontal flight 16 as may be required to define a desired conveyor path along which the carts 12 will be moved.

Figure 2:
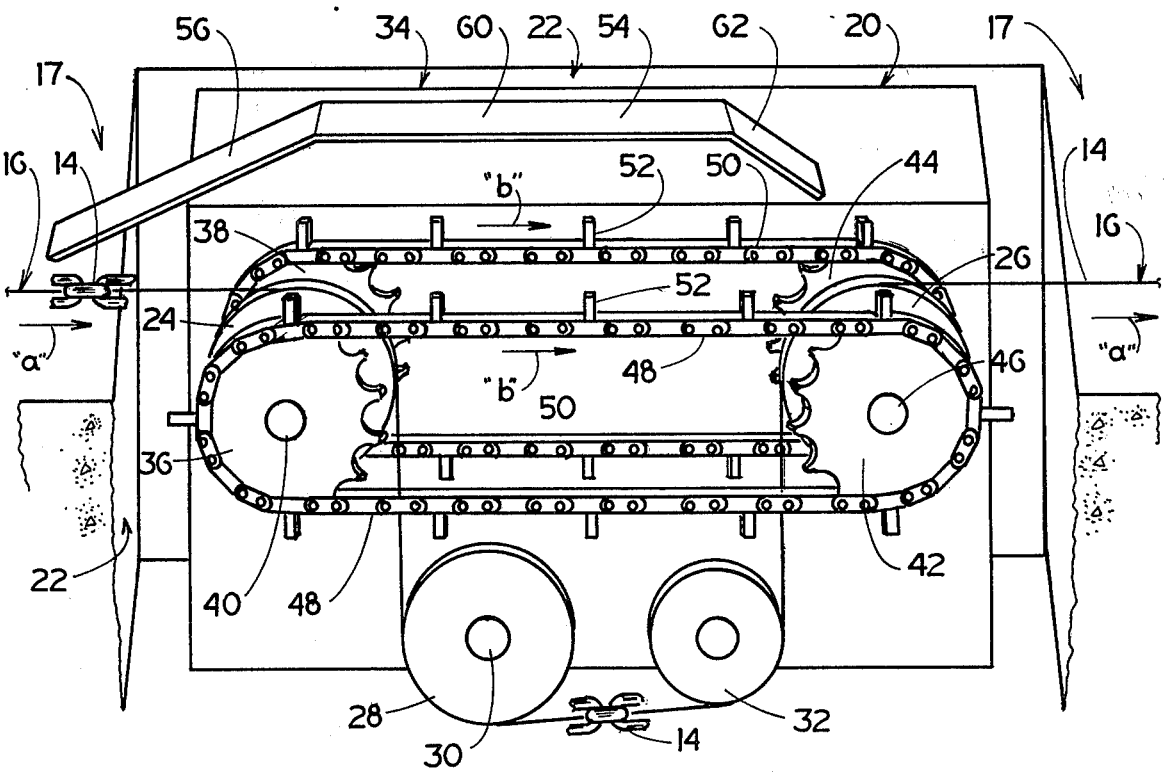
FIG. 2 is an enlarged perspective view of a portion of the conveyor system of FIG. 1 as viewed in generally in the direction of arrows 2—2 in FIG. 1.

As can be best seen in FIG. 2, the conveyor system 10 includes conveyor chain drive means such as, for example, an electric motor 20 for linearly moving the conveyor chain 14. The drive motor 20 is located in a pit 22 formed in the floor so that it is below the floor level. A conveyor chain idler head sprocket 24 and a conveyor chain idle tail sprocket 26 are located within the pit 22 toward opposite ends thereof from each other and in close proximity to the drive motor 20.

Both the conveyor chain head sprocket 24 and conveyor chain tail sprocket 26 have generally horizontal axis of rotation. The drive motor 20 has a conveyor chain drive sprocket 28 attached to the output shaft 30 of the drive motor 20 for rotation with the output shaft 20. The axis of rotation of the conveyor chain drive sprocket 28 is generally horizontal, and the conveyor chain drive sprocket 28 is disposed in proximity to, and below the conveyor chain head sprocket 24. The drive motor 20 further includes at least one idler conveyor chain tensioning sprocket 32. The axis of rotation of the idler conveyor chain tensioning sprocket 32 is generally horizontal, and the idler conveyor chain tensioning sprocket 32 is disposed in proximity to, and below the conveyor chain tail sprocket 26. The endless conveyor chain 14 is trained about at least a portion of the periphery of the head sprocket 24, trained about at least a portion of the periphery of the conveyor chain drive sprocket 28, trained about at least a portion of the periphery of the idler conveyor chain tensioning sprocket 32, and trained about at least a portion of the periphery of the conveyor chain tail sprocket 26. Thus, there is a gap in the horizontal flight 16 of the conveyor chain 14 between the conveyor chain head sprocket 24 and the conveyor chain tail sprocket 26.

With continued reference to FIGS. 1 and 2, a cart transfer station, generally denoted as the number 34, is positioned generally between the head sprocket 24 and the tail sprocket 26 for moving carts across the gap therebetween without interruption to the travel of the carts 12 along the conveyor path. As shown, the transfer station 34 comprises a pair of first chain sprockets 36 and 38 located on opposite sides of the conveyor chain head sprocket 24 and coaxially mounted therewith on the same axle shaft 40 as the head sprocket 24, and a pair of second chain sprockets 42 and 44 located on opposite sides of the conveyor chain tail sprocket 26 and coaxially mounted therewith on the same axle shaft 46 as the tail sprocket 26. A first endless chain 48 is trained about one of the first sprockets, for example first sprocket 36, and one of the second sprockets, for example second sprocket 42, which sprockets are located to one side of the horizontal flight 16. Similarly, a second endless chain 50 is trained about the other first sprocket 38 and the other second sprocket 44 which are located to the other side of the horizontal flight 16. Thus the top flights of the first endless chain 48 and second endless chain 50 are substantially parallel to the horizontal flight 16 of the conveyor chain 14 and span the gap between the conveyor chain head sprocket 24 and the conveyor chain tail sprocket 26. It should be noticed that the first sprockets 36 and 38 of the pair of first chain sprockets are of substantially the same dismeter as the conveyor chain head sprocket 24, and that the second sprockets 42 and 44 of the pair of second chain sprockets are substantially the same diameter as the conveyor chain tail sprocket 26 so that the first endless chain 48 and second endless chain 50 have substantially the same linear speed as the conveyor chain 14.

Each of the first and second endless chains 48 and 50, respectively, includes spaced apart dogs 52 projecting outwardly therefrom. Each dog 52 on one of the endless chains, for example the first endless chain 48, is aligned with a different one of the dogs 52 on the other endless chain, for example the second endless chain 50, so that the dogs 52 move in aligned pairs across the gap between the conveyor chain head sprocket 24 and conveyor chain tail sprocket 26.

The cart transfer station 34 further includes an elongated cam plate 54 located to one side of either the first or second endless chains, and spans the gap between the conveyor chain end sprocket 24 and conveyor chain tail sprocket 26. As shown, the cam plate 54 is located to one side of, and in generally parallel relationship to the top flight of the first endless chain 48. The elongated cam plate 54 comprises an upwardly sloping advance section 56, a generally horizontal, elongated dwell section 60, and a downwardly sloping return section 62. As shown the upwardly sloping advance section 56 begins to slope upwardly from the level of the horizontal flight 16 at a point upstream, relative to the direction of movement of the horizontal flight 16 indicated by the flow arrows "a", of the conveyor chain head sprocket 24 and reaches its maximum elevation proximate the axes of rotation of the conveyor chain head sprocket 24. The dwell section 60 extends generally horizonally from the location of the maximum elevation of the cam advance section 56 across the gap between the head and tail sprockets to a location generally upstream, relative to the direction of movement of the first and second endless chains 48 and 50 indicated by the flow arrows "b", of the axes of rotation of the conveyor chain tail sprocket 26. The downwardly sloping cam return section 62 begins to slope downwardly from the terminal end of the dwell section 60 to its bottom end at the level of the horizontal flight 16 proximate the axis of rotation of the conveyor chain tail sprocket 26.

Figure 3:
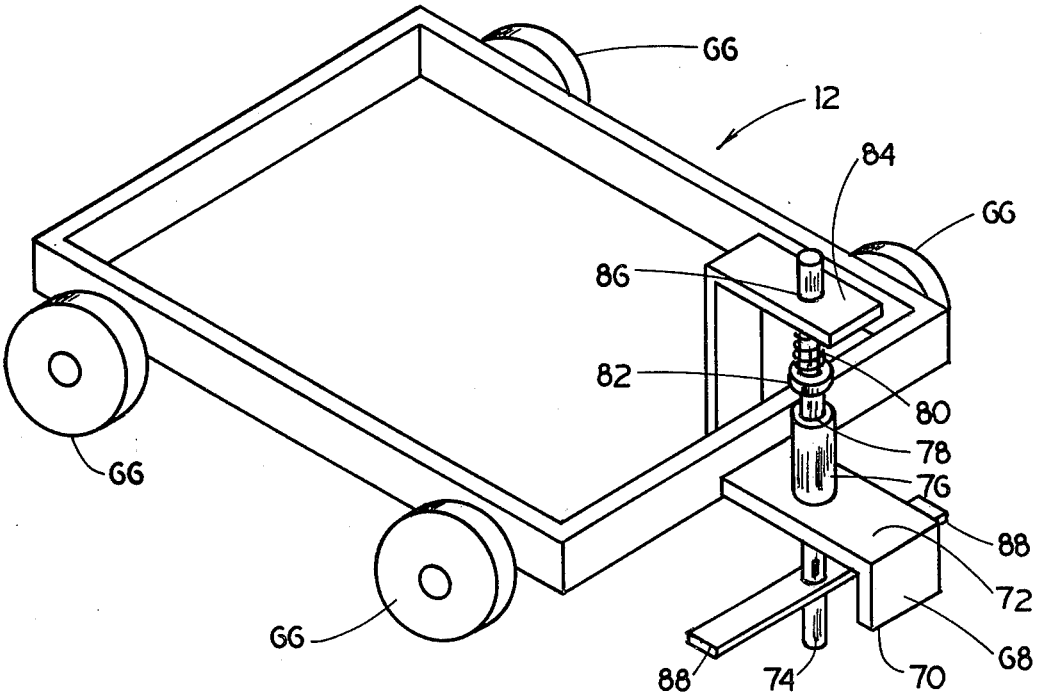
FIG. 3 is a perspective view of a load bearing unit embodying various features of the present invention.

With reference to FIG. 3, each of the carts 12 to be moved along the path defined by the horizontal flight 16 of the conveyor chain 14 comprises a frame structure 64, and floor engaging wheels 66 rotatably attached to the frame structure 64. The frame structure 64 can be of virtually any construction and configuration to support the load to be carried thereon.

Fixed position engagement means such as a fixed position finger 68 is attached to the cart frame 64 and depends therefrom a predetermined distance such that the tip 70 of the finger 68 is spaced above the horizonal flight 16 of the conveyor chain 14. The fixed position finger 68 is adapted to be engaged by the dogs 52 of the first and second endless chains 48 and 50, respectively, as will be hereinafter discussed. Toward this end, the finger tip 70 is at least as wide as the distance between the first endless chain 48 and second endless chain 50. As can be best seen in FIG. 3, the fixed position depending finger 68 is attached to the front end of the cart frame 64 by, for example a horizontal connecting plate 72 such that the depending finger 68 is spaced a distance in front of the cart frame 64.

With continued reference to FIG. 3, a depending moveable pin 74 is also attached to the cart frame 64. As shown, the moveable pin 74 is attached to the front of the cart frame 64 a distance in back of the fixed position finger 68. The moveable pin 74 is vertically movable between a lower, conveyor chain engaging position (shown in FIG. 3) and a raised, vertically displaced conveyor chain disengaged position.

Various constructions can be used to moveably attach the pin 74 to the cart frame 64. As illustrated in FIG. 3, the moveable pin 74 is axially, slidably received in a cylindrical collar 76, which collar is attached to the cart frame 64 with the longitudinal axis of its bore 78 being virtually disposed. The moveable pin 74 is biased toward the lower, conveyor chain engaging position by means of, for example, a coil spring 80 which is concentrically disposed over the portion of the pin 74 protruding from the top end of the collar 76. The coil spring 80 is placed under compression between a first spring retainer plate 82 attached to the portion of the pin 74 protruding from the top end of the collar 76 and a second spring retainer plate 84 affixed to the cart frame 64 a distance above the top end of the collar 76. The second spring retainer plate 84 is formed with a pin clearance hole 86 coaxial with the bore 78 of the collar 76. A cam plate follower 88 is attached to the portion of the pin 74 depending from the bottom end of the collar 76 and is positioned to engage and follow the advance section 56, dwell section 60 and return section 62 of the cam plate 54 so that the moveable pin 74 will be raised to the conveyor chain disengaged position as the cart moves across the gap between the head sprocket 24 and tail sprocket 26. As shown, the cam follower 88 is an elongated plate attached between its ends to the pin 74 and extending therefrom toward each side of the conveyor chain 14 a sufficient distance to overlay the cam plate 54 regardless of to which side the conveyor chain 14 the cam plate is located. Alternatively, the cam plate follower 88 can be an elongated plate attached at one of its ends to the pin 74 and extending therefrom toward that side of the conveyor chain 14 to which the cam plate 54 is located, and is long enough to overlay the cam plate 54. The cam plate follower 88 is attached to the pin 74 at a distance below the bottom end of the collar 76 generally corresponding to the distance the pin 74 will be moved upwardly from the conveyor chain engaged postion to the conveyor chain disengaged position.

In operation, the moveable pin 74 is biased by the coil spring 80 to the lower conveyor chain engaging position so that the depending end of the pin 74 engages the links of the conveyor chain 14. Thus, as the conveyor chain 14 moves linearly the cart 12 is caused to move with the conveyor chain 14 along the defined path. As the cart 12 approaches the head sprocket 24 of the conveyor system before the cart 12 reaches the pit 22, the cam plate follower 88 attached to the moveable pin 74 contacts the upwardly sloping advance section 56 of the cam plate 54 causing the pin 74 to be gradually raised, against the biasing force of the coil spring 80, to the raised position disengaging from the conveyor chain 14. As the moveable pin 74 disengages from the conveyor chain 14 the finger tip 70 of the fixed position finger 68 is contacted by the dogs 52 on the upper flight of the first endless chain 48 and second endless chain 50 of the transfer station 34. The dogs 52 in contact with the finger 68 move the cart 12, with the first endless chain 48 and second endless chain 50, across the gap between the conveyor chain head sprocket 24 and the conveyor chain tail sprocket 26 without interruption of the movement of the cart 12. As the cart 12 moves with the first and second endless chains 48 and 50, respectively, of the transfer station 34, the cam plate follower 88 moves across the dwell section 60 of the cam plate 54 holding the pin 74 in the raised position. As the cart 12 approaches the other end of the gap at the conveyor chain tail sprocket 26, the cam plate follower 88, due to the biasing force of the coil spring 80, follows the downwardly sloping return section 62 of the cam plate 54. Thus, the pin 74 is gradually lowered back to the lower conveyor chain engaging position whereupon the depending end of the pin 74 re-engages the links of the conveyor chain 14 proximate the conveyor chain tail sprocket 28 and the dogs 52 disengage from the fixed position finger 68 for continued, uninterrupted movement of the cart 12 with the conveyor chain 14 along the defined path.

Figure 4:
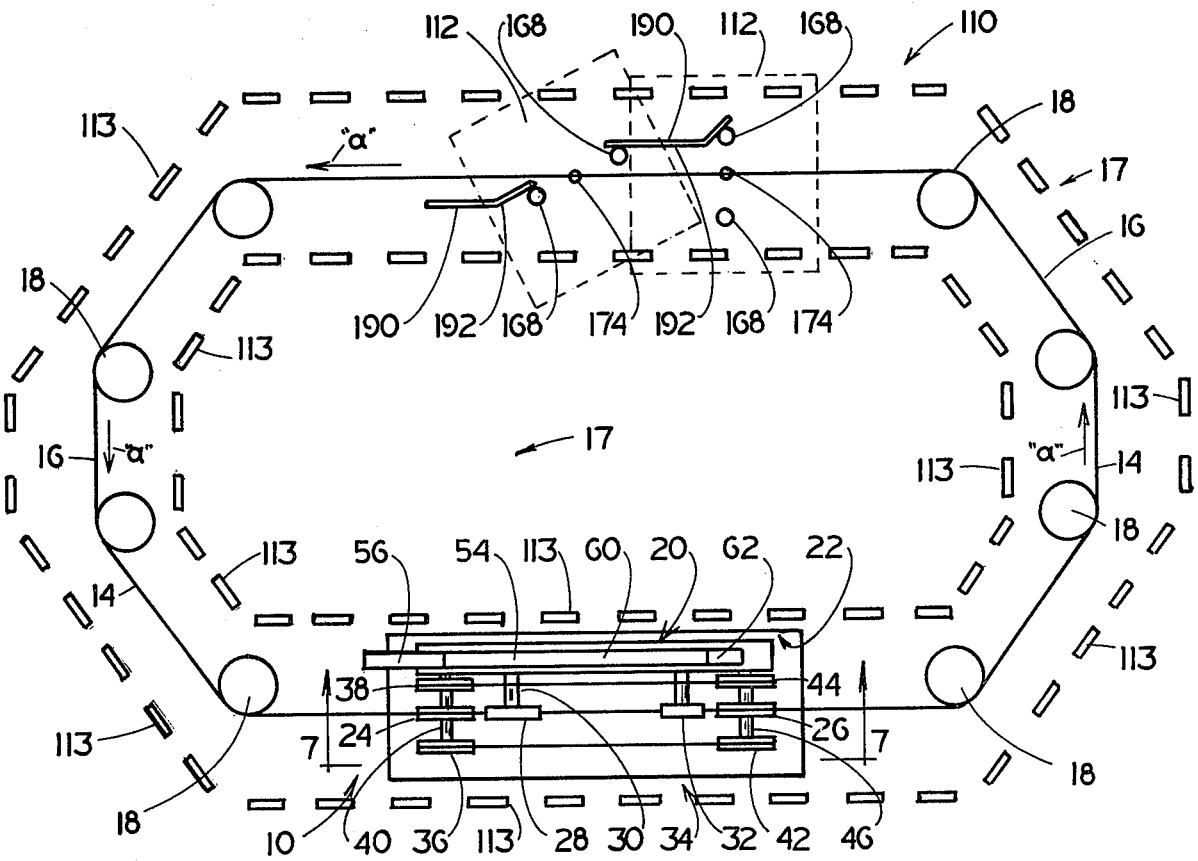
FIG. 4 is a plan view of another conveyor system embodying the present invention.
Figure 5:
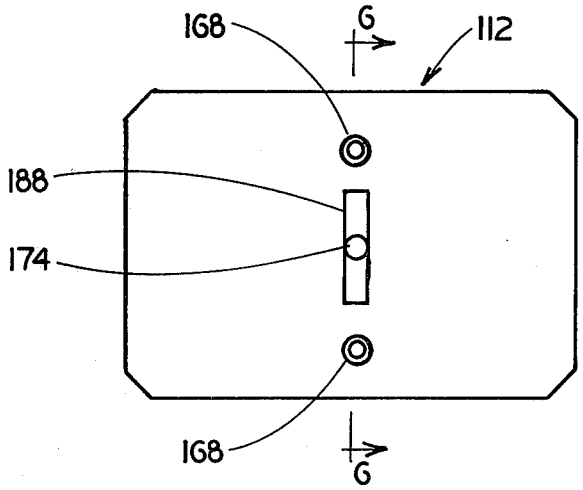
FIG. 5 is a bottom view of another type load bearing unit embodying various features of the present invention.

FIGS. 4 and 5 illustrate a further endless conveyor system, generally denoted by the numeral 110, used in industry. Comparing the conveyor system 110 with the conveyor system 10, essentially the only difference is that the wheeled carts 12 have been replaced by wheelless pallets 112. In order to allow the wheelless pallets 112 to smoothly move along the path defined by the flight 16 of the endless conveyor chain 14, floor mounted dead rollers 113 are installed to each side of the endless conveyor 14. The pallets 112 are supported above the facility floor 17 by and ride on the rollers 113 as they are pulled along the defined path by the endless conveyor chain 14.

Figure 6:
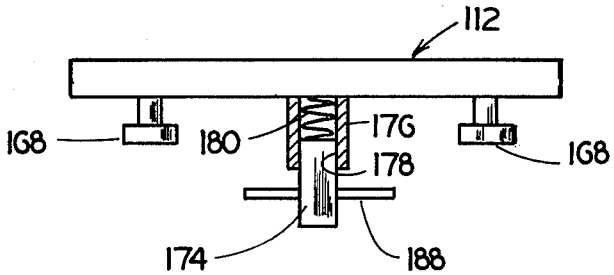
FIG. 6 is an enlarged cross-sectional view taken in the direction of arrows 6—6 in FIG. 5.

With reference to FIGS. 5 and 6, the pallet 112 is pulled by the endless conveyor chain 14 by means of a movable pin 174 depending from the pallet 112. As shown, the movable pin 174 is attached at approximately the geometric center of the pallet 112 and is vertically movable between a lower, conveyor chain engaging position (shown in FIG. 6) and a raised, vertically displaced, conveyor chain engaged position.

While enumerable constructions can be used to movably attach the pin 174 to the pallet 112, as illustrated in FIG. 6, the movable pin 174 is axially, slidably received in a cylindrical collar 176, which collar is attached to the pallet 112 with the longitudinal axis of its bore 178 being vertically disposed. The movable pin 174 is biased toward the lower, conveyor chain engaging position by means of, for example, a coil spring 180 which is located in the collar bore 178 between the top end of the pin and the bottom surface of the pallet 112. The coil spring 180 is placed under compression between the top end of the pin 174 and the bottom surface of the pallet. A cam plate follower 188 is attached to the portion of the pin 174 depending from the bottom end of the collar 176 and is positioned to engage and follow the advance section 56, dwell section 60 and return section 62 of the cam plate 54 so that the movable pin 174 will be raised to the conveyor chain disengaged position as the pallet 112 moves across the gap between the head sprocket 24 and tail sprocket 26. To this end, the cam follower 188 is shown as an elongated plate attached between its ends to the pin 174 and extending therefrom toward each side of the conveyor chain 14 a sufficient distance to overlay the cam plate 54 regardless of to which side of the conveyor chain the cam plate is located.

In operation, the movable pin 174 is biased by the coil spring 180 to the lower conveyor chain engaging position so that the depending end of the pin 174 engages the links of the conveyor chain 14. Thus, as the conveyor chain 14 moves linearly the pallet 112 is caused to move with the conveyor chain 14, riding on the rollers 113, along the defined path.

As the pallet 112 is pulled along the path defined by the conveyor chain 14, it is sometimes desirable that the pallet 112 be pivoted or rotated in a generally horizontal plane so that various areas of a workpiece carried on the pallet 112 will be exposed to a workstation to eliminate the need for a workman at the workstation to move around the workpiece to perform an operation on the workpiece. The pivoting of the pallet 112 to expose various areas of the work piece carried thereon to a stationary workstation is particularly advantageous in those situations wherein the workstation includes automated equipment. The horizontal rotating motion of the pallet 112 as it moves along the path of the conveyor chain 14 is illustrated in phantom lines in FIG. 4. Now with continued reference to FIG. 4 and additional reference to FIGS. 5 and 6, to accomplish selected horizontal rotation of the pallet 112, the pallet is equipped with at least one, but preferrably two fixed positions, depending rollers 168 attached to the pallet to each side of the movable pin 174. The rollers 168 are each mounted for free rotation in a horizontal plane about vertically oriented axis of rotation. The rollers 168 serve a dual function as will be hereinafter described. Further, pallet rotation means are located at selected locations along the path of the conveyor chain 14 which cooperates with the depending rollers 168 of the pallet to cause the pallet to rotate in the horizontal plane. As shown in FIG. 4, the pallet rotation means comprises a fence-like pallet guide cam 190 mounted to project upwardly form the facility floor 17 to present a vertical cam surface 192 to the depending pallet rollers 168. The pallet guide cam 190 is configured to present a cam surface 192 dictated by the desire to rotate the pallet, and the duration the pallet is to remain at any desired rotated position. It is possible to configure the pallet guide cam 190 so the pallet can be rotated through 360 degrees as the pallet moves with the conveyor chain 14.

For the sake of clearity, as illustrated in FIG. 4, the pallet guide cam 190 is configured to rotate a pallet 112 through less than 90 degrees and then back to a position aligned with the conveyor chain 14. In cooperative conjunction with the pallet guide cam 190, the rollers 168 of the pallet 112 function as a cam follower. As shown, as the pallet 112 is moved by the conveyor chain 14 past the pallet guide cam 190 one of the rollers 168 contacts the cam surface 192 and follows the cam surface configuration causing the pallet 112 to rotate about the depending pin 174, as the center of rotation, to a desired extent dictated by the configuration of the cam surface. If it is desired, for example, to rotate the pallet 112 back to the aligned position with the conveyor chain, a subsequent pallet guide cam 190 having the appropriately configured cam surface 192 can be located so that the other one of the rollers 168 of the pallet 112 will contact the cam surface 192 thereof and follow that cam surface configuration causing the pallet 112 to rotate in the other rotational direction about the depending pin 174. The pallet rollers 168 are rotatably mounted to the pallet to minimize wear on the rollers themselves as well as to the cam surface 192 of the pallet guide cam 190.

It should be clearly understood that the above discussion relating to rotating the pallet first in one rotational direction and then back in the other rotational direction is not to be understood as limiting in any manner the useful cam surface configurations or sequence of rotation of the pallet 112 for the reason that the amount of pallet rotation and sequence of follow on rotation motions, if any, will be dictated by the tasks to be performed on a workpiece carried by the pallet 112.

Figure 7:
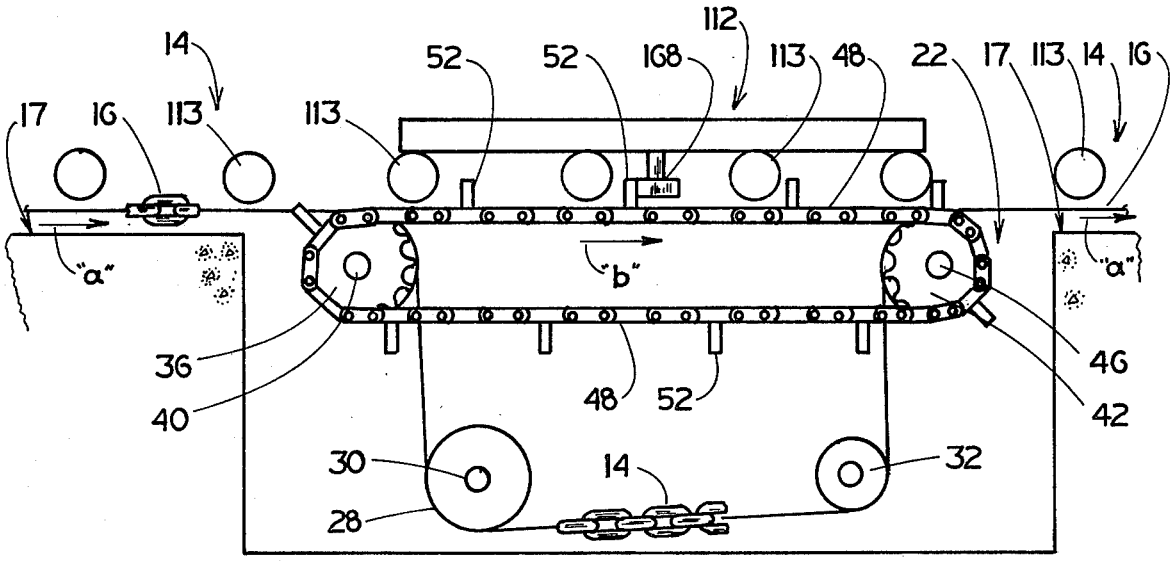
FIG. 7 is an enlarged side view of a portion of the conveyor system of FIG. 4 as viewed in the direction of arrows 7—7 in FIG. 4.

Referring now to FIGS. 2, 4 and 7 as the pallet 112 approaches the head sprocket 24 of the conveyor chain, before the pallet 112 reaches the pit 22, the cam plate follower 188 attached to the movable pin 174 contacts the upwardly sloping advance section 56 of the cam plate 54 causing the pin 174 to be gradually raised, against the biasing force of the coil spring 180, to the raised position disengaging from the conveyor chain 14. As the movable pin 174 disengages from the conveyor chain 14 the roller 168 depending from the pallet 112 at one side of the movable pin 174 is contacted by one of the dogs 52 on the upper flight of the first endless chain 48 and the other roller 168 depending from the pallet 112 at the other side of the movable pin 174 is contacted by one of the dogs 52 on the second endless chain 50 of the transfer station 34. The dogs 52 in contact with the depending rollers 168 move the pallet 112 with the first endless chain 48 and second endless chain 50, across the gap between the conveyor chain head sprocket 24 and the conveyor chain tail sprocket 26 without interruption of the movement of the pallet 112. Thus in transporting the pallets 112 across the discontinuity in the defined path of the conveyor chain 14, the fixed position rollers 168 functions as fixed position engagement means.

As the pallet 112 moves with the first and second endless chains 48 and 50, respectively, of the transfer station 34, the cam plate follower 188 moves across the dwell section 60 of the cam plate 58 holding the pin 174 in the raised position. As the pallet 112 approaches the other end of the gap at the conveyor chain tail sprocket 26, the cam plate follower 188, due to the biasing force of the coil spring 180, follows the downwardly sloping return section 62 of the cam plate 54. Thus, the pin 174 is gradually lowered back to the lower conveyor chain engaging position whereupon the depending end of the pin 174 re-engages the links of the conveyor chain 14 proximate the conveyor chain tail sprocket 28 and the dogs 52 disengage from the depending rollers 168 for continued uninterrupted movement of the pallet 112 with the conveyor chain 14 along the defined path.

While the above detailed description discusses the transfer station 34 in use in a conveyor system having a single conveyor chain, it should be eminently clear that the principles of the transfer station 34 is useful in virtually any type of conveyor system wherein a discontinuity or gap is present along the path of movement of the conveyor system. For example, the transfer station 34 is also advantageously applied to a conveyor system comprising two or more conveyors in spaced relationship to each other wherein it is desired to transfer items in an uninterrupted flow from one conveyor to the other conveyor.

The foregoing detailed description is given primarily for clearness of understanding, and no unnecessary limitations are to be understood therefrom for modifications will become obvious to those skilled in the art upon reading this disclosure and may be made without departing from the spirit of the invention and scope of the appended claims.

What is claimed is:

1. A conveyor system for moving load bearing units along a path defined by the conveyor system, comprising:

endless conveyor means having at least one flight thereof defining the path to be traveled by the load bearing units, said at least one path defining flight having a discontinuity along the defined path;

an endless conveyor transfer device disposed across the discontinuity in said at least one path defining flight of said endless conveyor device;

fixed position engagement means attached to each of the load bearing units said engagement means being adapted to engage said endless conveyor transfer device for movement of the load bearing units with said endless conveyor transfer device across the discontinuity;

moveable pin means attached to each of the load bearing units, said pin means being movable between an endless conveyor device engaged position, in which engaged position the load bearing units are connected to said at least one path defining flight of said endless conveyor means for movement therewith along the defined path, and an endless conveyor means disengaged position; and means for activating said movable pin means to the endless conveyor means disengaged position proximate the upstream end of the discontinuity as said engagement means engages said endless conveyor transfer device and for actuating said moveable pin means to the endless conveyor means engaged position proximate the downstream end of the discontinuity as said engagement means disengages said endless conveyor transfer device.

2. The conveyor system defined in claim 1 wherein:

said means for actuating said moveable pin means comprises cam means having a cam advance section proximate the upstream end of the discontinuity, a cam dwell section extending across at least a portion of the discontinuity and a cam return section proximate the downstream end of the discontinuity; and a cam follower operatively associated with said moveable pin means for following said cam means and moving said moveable pin means as dictated by said cam means between said endless conveyor means engaged and disengaged positions.

3. The conveyor system defined in claim 1 wherein said moveable pin means is biased toward said endless conveyor means engaged position.

4. The conveyor system defined in claim 1 wherein said endless conveyor transfer device comprises:

at least one first sprocket located proximate the upstream end of the discontinuity;

at least one second sprocket located proximate the downstream end of the discontinuity;

at least one endless chain trained about said at least one first sprocket and said at least one second sprocket such that the top flight of said endless chain substantially spans the discontinuity; and said fixed position engagement means attached to each of the load bearing units is adapted to engage the top flight of said endless chain.

5. The conveyor system defined in claim 4 wherein:

said endless conveyor means comprises a head sprocket at the upstream end of the discontinuity, and a tail sprocket at the downstream end of the discontinuity;

said at least one first sprocket of said endless conveyor transfer device being coaxially disposed with said head sprocket of said endless conveyor means; and said at least one second sprocket of said endless conveyor transfer device being coaxially disposed with said tail sprocket of said endless conveyor means.

6. The conveyor system defined in claim 5 wherein:

said head sprocket of said endless conveyor means and said at least one first sprocket of said endless conveyor transfer device rotate at the same angular velocity; and said tail sprocket of said endless conveyor means and said at least one second sprocket of said endless conveyor transfer device rotate at the same angular velocity.

7. The conveyor system defined in claim 6 wherein:

said head sprocket of said endless conveyor means and said at least one first sprocket of said endless conveyor transfer device are of generally the same diameter; and said tail sprocket of said endless conveyor means and said at least one second sprocket of said endless conveyor transfer device are of generally the same diameter.

8. The conveyor system defined in claim 5, wherein said means for actuating said moveable pin means is a cam comprising:

a cam advance section sloping upwardly from a location upstream of said head sprocket of said endless conveyor means to a maximum cam advance position generally aligned with the axis of rotation of said head sprocket of said endless conveyor means;

a cam dwell section extending generally horizontal, from the maximum cam advance position of said cam advance section, across the discontinuity toward said tail sprocket of said endless conveyor means to a location upstream of said tail sprocket; and a cam return section sloping downwardly from termination of said cam dwell section to a cam return position generally aligned with the axis of rotation of said tail sprocket of said endless conveyor means.

9. The conveyor system defined in claim 1 further comprising drive means which drives both said endless conveyor means and said endless conveyor transfer device.

10. The conveyor system defined in claim 1 wherein:

said endless conveyor means comprises a head sprocket at the upstream end of the discontinuity, and a tail sprocket at the downstream end of the discontinuity; and said endless conveyor transfer device comprises a pair of first sprockets, said first sprockets of said pair being disposed to opposite sides of and coaxially located with said head sprocket of said endless conveyor means, a pair of second sprockets, said second sprockets of said pair being disposed to opposite sides of and coaxially located with said tail sprocket of said endless conveyor means, a first endless chain trained about one of said first sprockets and one of said second sprockets, and a second endless chain trained about the other of said first sprockets and the other of said second sprockets.

11. The conveyor system defined in claim 9 further comprising engagement means engaging dogs projecting outwardly from and spaced apart along said first and second endless chains of said endless conveyor transfer device, each engagement means engaging dog of one endless chain being in alignment with a different one of said engagement means engaging dogs of the other endless chain.

12. The conveyor system defined in claim 1, further comprising means for rotating the load bearing units in a generally horizontal plane as the load bearing units are moved along the path defined by the conveyor system.

13. The conveyor system defined in claim 12, wherein said means for rotating the load bearing units in a generally horizontal plane comprises:

cam means located next to said endless conveyor means; and cam follower means associated with the load bearing unit and adapted to follow the configuration of said cam means.

14. The conveyor system defined in claim 13, wherein said fixed position engagement means and said cam follower means are one in the same.

15. The conveyor system defined in claim 12 wherein the load bearing units are adapted to rotate in a horizontal plane about said moveable pin means as the center of rotation.

* * * * *